US008196541B2

(12) United States Patent
Buxton

(10) Patent No.: US 8,196,541 B2
(45) Date of Patent: Jun. 12, 2012

(54) PERSONAL SUPPORT SYSTEM FOR NAUTICAL VESSELS

(76) Inventor: Martin Buxton, Signal Hill, CA (US)

( * ) Notice: Subject to any disclaimer, the term of this patent is extended or adjusted under 35 U.S.C. 154(b) by 379 days.

(21) Appl. No.: 12/353,943

(22) Filed: Jan. 14, 2009

(65) Prior Publication Data

US 2009/0183668 A1 Jul. 23, 2009

Related U.S. Application Data

(60) Provisional application No. 61/020,863, filed on Jan. 14, 2008.

(51) Int. Cl.
*B63B 17/00* (2006.01)

(52) U.S. Cl. ..... 114/363; 114/218

(58) Field of Classification Search ..... 114/218, 114/363; 254/266, 323, 344
See application file for complete search history.

(56) References Cited

U.S. PATENT DOCUMENTS

| | | | | | |
|---|---|---|---|---|---|
| 1,625,871 | A | * | 4/1927 | Robertson et al. | 254/323 |
| 2,530,586 | A | * | 11/1950 | Smith | 254/266 |
| 2,722,907 | A | * | 11/1955 | Dyer | 114/218 |
| 3,145,974 | A | * | 8/1964 | Short | 254/323 |
| 3,770,244 | A | * | 11/1973 | McCloud | 114/218 |
| 3,776,517 | A | * | 12/1973 | Davis et al. | 114/218 |
| 4,292,911 | A | * | 10/1981 | Lindsay | 114/218 |
| 4,425,863 | A | | 1/1984 | Cutler | |
| 4,589,366 | A | | 5/1986 | Eiber | |
| 4,803,945 | A | * | 2/1989 | Adams et al. | 114/363 |
| 4,883,255 | A | | 11/1989 | Bacon | |
| 4,944,557 | A | | 7/1990 | Tsubai | |
| 5,934,749 | A | | 8/1999 | Pond | |
| 6,015,186 | A | | 1/2000 | Grieger | |
| 6,491,285 | B1 | * | 12/2002 | Tomita | 254/266 |
| 6,945,190 | B1 | * | 9/2005 | Frandsen | 114/363 |

FOREIGN PATENT DOCUMENTS

| | | |
|---|---|---|
| DE | 196 47 688 A1 | 5/1998 |
| GB | 2 151 559 A | 8/1983 |

OTHER PUBLICATIONS

"Aqua Seat," TITAN USA's winch seat (Aqua Seat), I pg., http://www.ectn2.com/titanusa/wseats.shtml, printed Mar. 16, 2009.

"Aqua Seat," Titan USA's winch seat (Aqua Seat) accessories, 1 pg., http://ecm2.com/titanusa/seataccess.shtml, printed Mar. 16, 2009.

PCT International Search Report completed Feb. 20, 2009 and mailed Mar. 16, 2009 from corresponding PCT Application No. PCT/US2009/031023 filed Jan. 14, 2009 (2 pages).

PCT Written Opinion of the International Searching Authority completed Feb. 20, 2009 and mailed Mar. 16, 2009 from corresponding PCT Application No. PCT/US2009/031023 filed Jan. 14, 2009 (5 pages).

* cited by examiner

*Primary Examiner* — Lars A Olson

(57) ABSTRACT

A personal support system for persons in the cockpit of a nautical vessel is disclosed. The system includes a personal support device that releasably engages a nautical winch located near the cockpit to provide support or securing for the back or other parts of the body of a person seated, standing, or otherwise located in the cockpit. The system also includes a winch-substitute device that attaches to the vessel and releasably engages the personal support device, allowing use of the personal support device in locations in the cockpit that are not near a winch.

32 Claims, 21 Drawing Sheets

PERSONAL SUPPORT SYSTEM FOR NAUTICAL VESSELS

CROSS-REFERENCE TO RELATED APPLICATION

This application claims the benefit of U.S. Provisional Application No. 61/020,863, filed Jan. 14, 2008, the disclosure of which is incorporated herein by reference.

BACKGROUND

The cockpit of a sailboat or other small to mid-size nautical vessel usually features seating for the boat's crew and passengers. However, this seating is normally in the form of a bench and not very comfortable, especially for longer runs or voyages, as it does not provide good back support. People sitting on the benches normally must make do with putting their backs up against the side wall of the cockpit that extends up to the winch/coaming deck, which wall is hard and does not extend very far up vertically, as shown in FIG. 1. Passengers may use also pillows or other loose pads, but these do not provide much back support, and they can be thrown out of place or even cast overboard by the motion of the vessel and the sea.

SUMMARY OF THE INVENTION

Probably a main reason why permanent seat backs are not provided in the cockpit of a sailboat or other small to mid-size nautical vessel is that such seat backs might interfere with necessary access to the winches positioned on the winch/coaming deck immediately outboard of the cockpit. The present invention turns the presence of those winches instead into an advantage for providing comfortable body support for persons sitting or standing in the cockpit.

Accordingly, one embodiment of the present invention presents a device for supporting or securing one or more persons aboard a nautical vessel that has a winch proximate to a cockpit, comprising a body support configured to engage a body of a person located at least partially in the cockpit, a winch anchor releasably engageable with the winch, and a positioning spacer extending between the body support and the winch anchor and having a length for fixing a distance between the winch anchor and the body support. An embodiment of the present invention presents a portable, removable personal support device that fits into the top socket of a nautical winch to stabilize and position the personal support device as a seatback or other bodily support or securing point for comfortable use by persons located in the cockpit of the vessel. Another embodiment of the present invention presents a winch-substitute device comprising a fitting releasably engageable with a winch anchor of a personal support device for a nautical vessel. An embodiment of the present invention presents a winch-substitute device with a fitting having a recess similar to that found on a nautical winch's top socket for mating with a portable personal support device, allowing use of such device even in locations in the cockpit where there is no nearby winch.

DETAILED DESCRIPTION

Personal Support Device

The detailed description set forth below in connection with the drawings is intended as a description of the presently preferred embodiments of a personal support system in accordance with aspects of the present invention, and is not intended to represent the only forms in which the present invention may be constructed or utilized. The description sets forth aspects of the personal support system of the present invention in connection with the illustrated embodiments. It is to be understood that the same or equivalent functions and structures may be accomplished by different embodiments and are also intended to be encompassed within the spirit and scope of the present invention, especially those functions and structures incorporating a combination of features shown in the different embodiments included herein. Like element numbers used among multiple drawings are intended to indicate like or similar elements or features.

Figure 1:
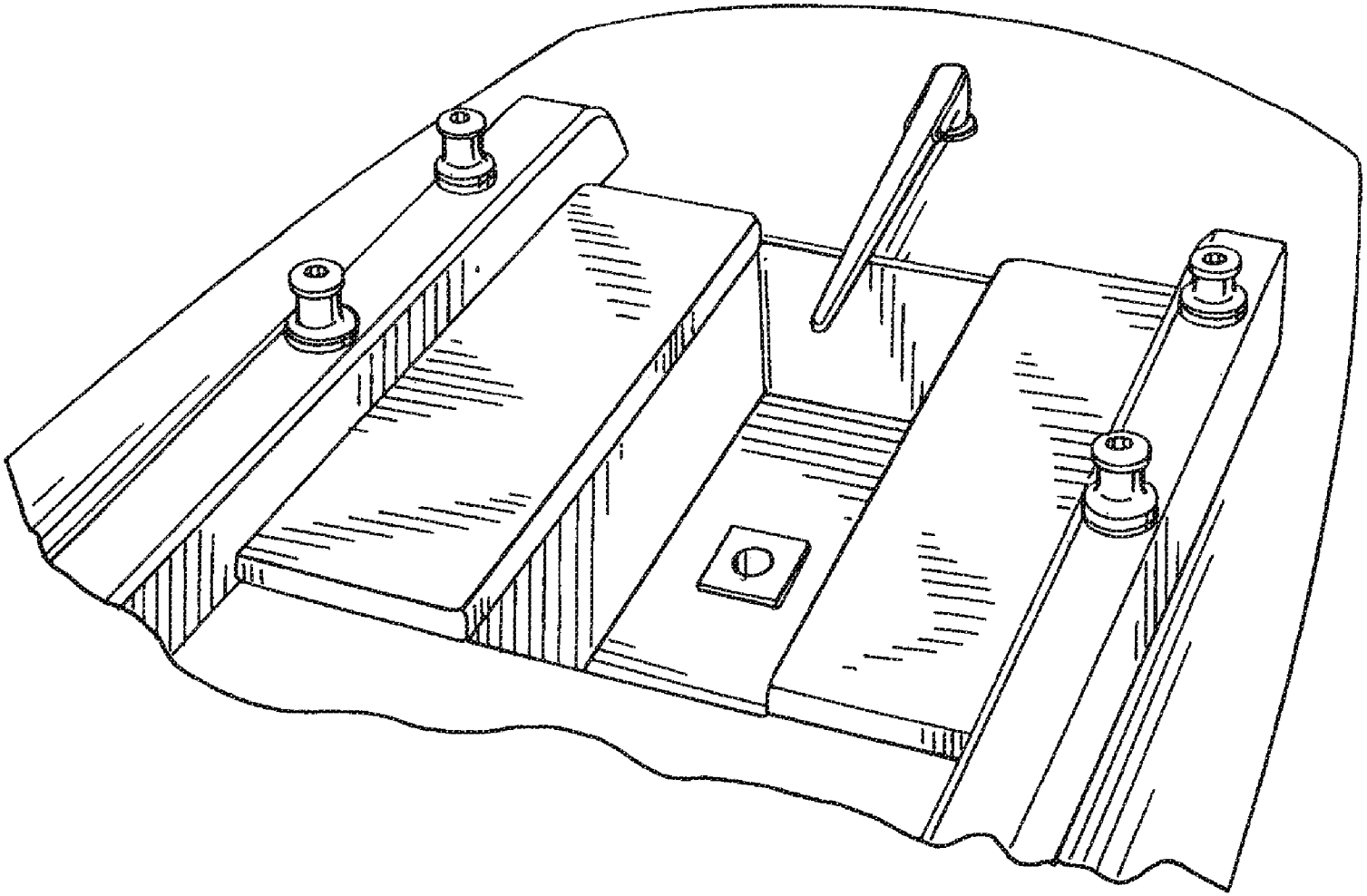
FIG. 1 is a perspective view of the cockpit and winch/coaming decks of a typical nautical vessel.
Figure 2:
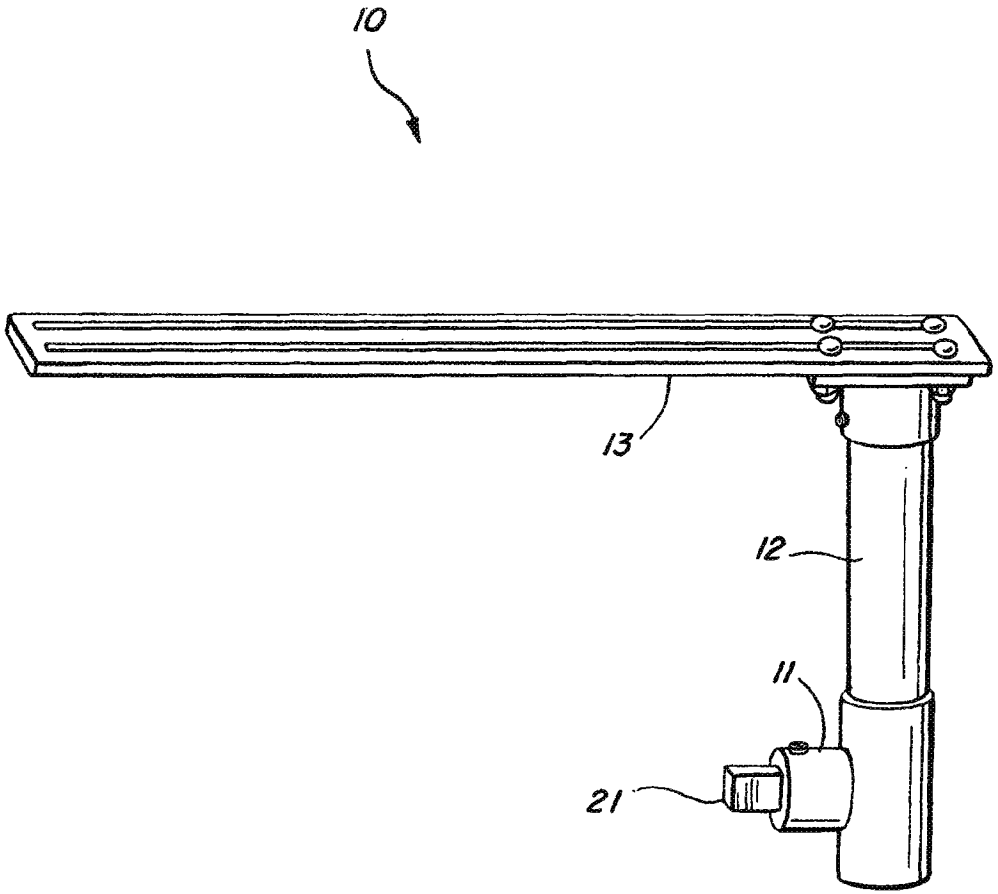
FIG. 2 is a perspective view illustration of an embodiment of a personal support device in accordance with the present invention.

FIG. 2, shows an exemplary personal support device, which is designated generally as 10. Broadly speaking, the personal support device 10 comprises three portions: a winch anchor 11 (the word "anchor" is used in its mechanical sense rather than its nautical sense) permitting the personal support device to releasably engage a nautical winch (not shown) or a winch-substitute device (not shown); a body support 13 for supporting at least a portion of the body of a person who is at least partially located, for example sitting or standing, in the cockpit; and a positioning spacer 12 for positioning the body support 13 laterally away from the winch anchor 11 and toward the cockpit, and so for positioning the body support 13 proximate to at least a portion of such person's body, such as the back. The body support shown or described in all the embodiments described herein, along with all equivalents, can be a means for supporting the body of a person located at least partially in the cockpit of the nautical vessel. The winch anchor shown or described in all the embodiments described herein, along with all equivalents, can be a means for releasably engaging the personal support device with a winch on the vessel. The positioning spacer shown or described in all the embodiments described herein, along with all equivalents, can be a means for positioning said supporting means to permit the supporting means to engage the body.

Figure 3:
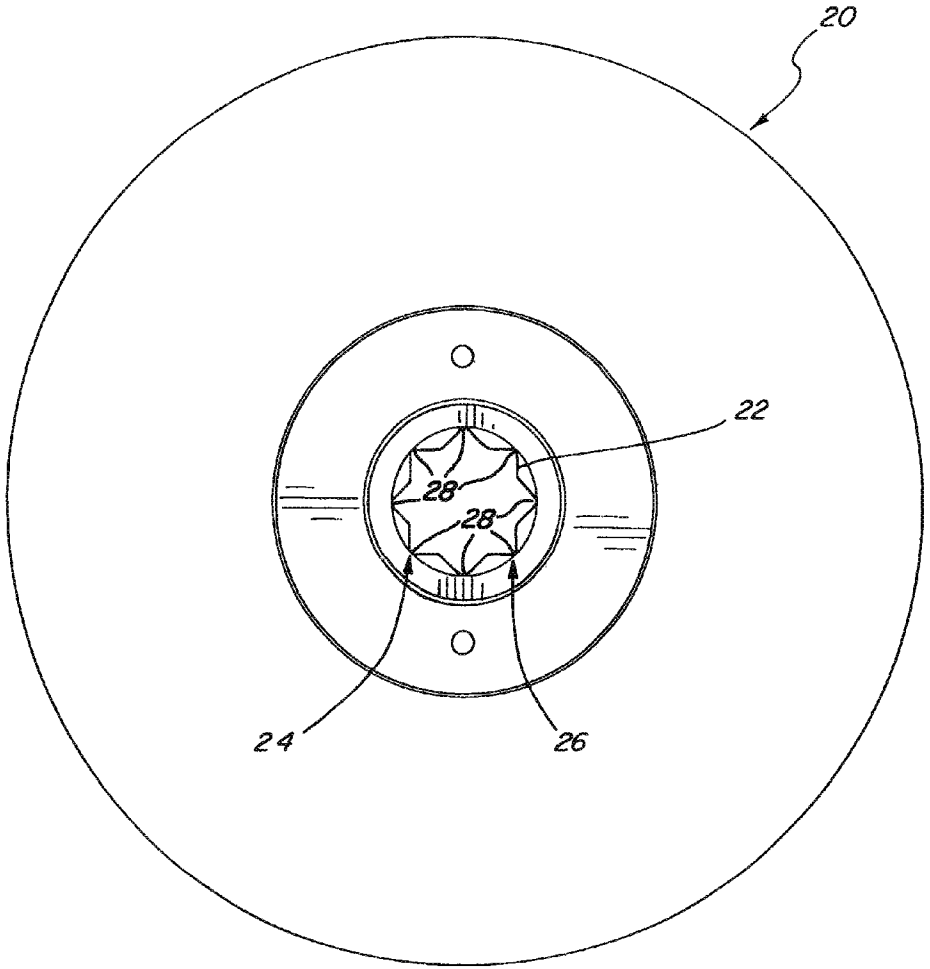
FIG. 3 is a top plan view of a typical nautical winch and top socket.

Manually driven nautical winches, typified by a winch 20 shown in FIG. 3, ubiquitously feature a standard socket in the center of their top, typified by a top socket 22, for insertion of a crank handle. The cross-sectional shape of a top socket recess is typically an octagon of standard size, measuring approximately 0.700" or 11/16" from one edge plane 24 of the opening to a parallel edge plane 26 at the other side of the opening. In one embodiment of the invention, as shown in FIG. 2, the winch anchor 11 comprises a winch post 21 that inserts into and mates with a standard winch top socket, thus engaging and anchoring the personal support device to the winch and stabilizing the personal support device in place. The cross section of the winch post 21 is shown as 11/16ths of an inch square, thus mating with four of the eight notches 28 of the standard octagonal winch top socket. Alternatively, however, the winch post may also be of other shapes or sizes without deviating from the spirit and scope of the present invention; for example, it may be octagonal and mate with all eight notches of the standard winch top socket, or it may be hexagonal, triangular, or of any other shape and/or size that mates with a standard winch top socket or with a non-standard socket of different shape and size. The winch post may be permanently affixed to the rest of the winch anchor or to the connecting spacer, or alternatively, detachable from the rest of the winch anchor or the connecting spacer, and/or attachable to the rest of the winch anchor or to the connecting spacer through an adaptor or a quick-disconnect device.

Figure 4:
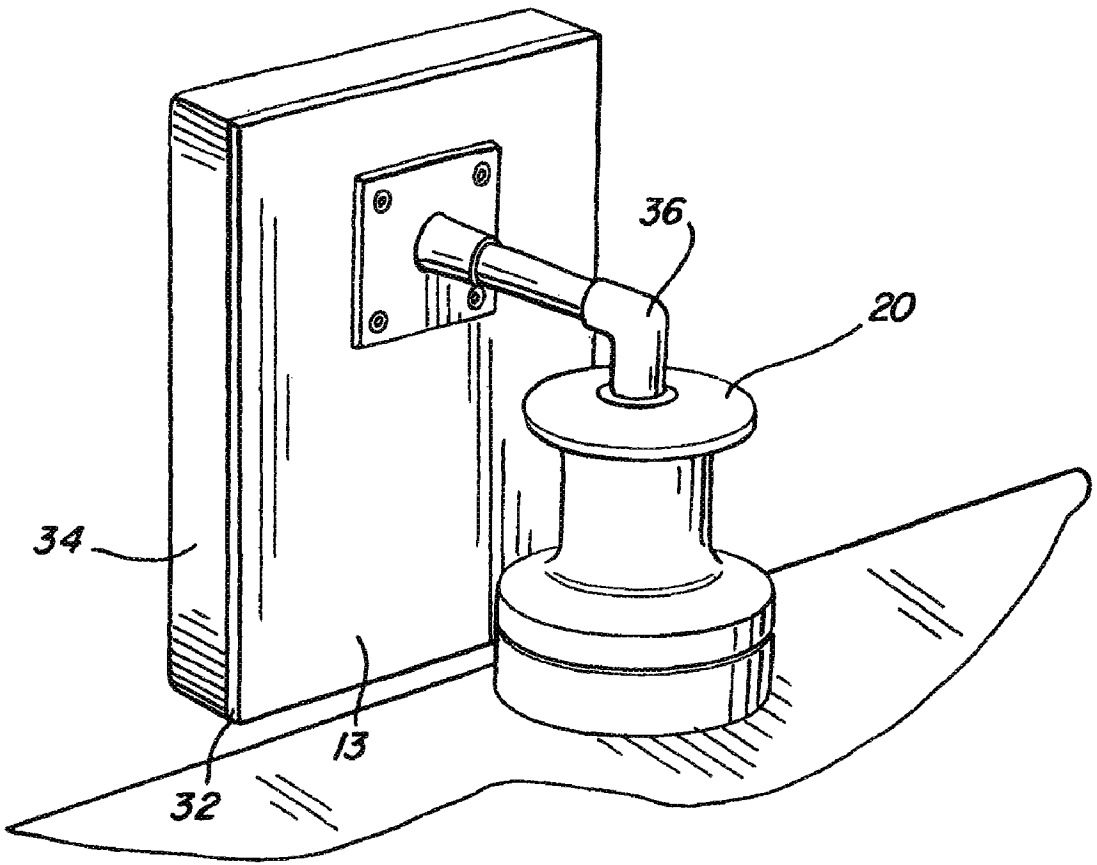
FIG. 4 is a perspective view of an embodiment of a fully fixed personal support device inserted into the top socket of a nautical winch.

FIG. 4 shows a personal support device with its winch post (not visible) inserted into the top socket (not visible) of winch 20. The personal support device releasably engages the winch and may be removed from the winch at any time, as when necessary to access the winch to adjust or tighten it or to secure a rope to it or loosen a rope from it. In the embodiment shown, this may be done by pulling the winch post of the personal support device up and out of the winch's top socket. However, the socket post or winch anchor may also feature a detent or latching device (not shown) that more firmly retains the personal support device in position in the top socket, requiring for example either firmer applied force or release of a latch before the personal support device may be removed.

Figure 5:
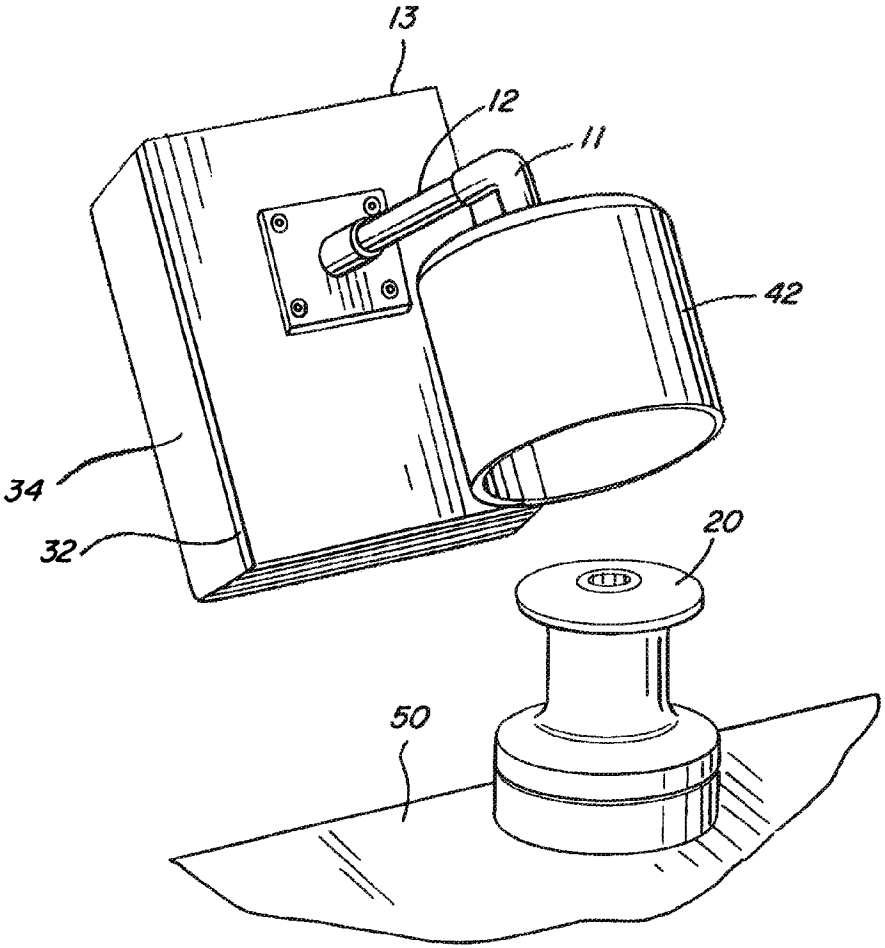
FIG. 5 is a perspective view of an embodiment of a personal support device featuring a generally cylindrical shell that engages the body of a nautical winch.

FIG. 5 shows an alternative embodiment, wherein instead of or in addition to the winch pin, the winch anchor comprises a generally cylindrical shell 42 or other hollow structure that fits down over and receives at least part of the winch drum, and so releasably engages the drum of a winch 20. As with a winch anchor featuring a winch post, a winch anchor featuring a cylindrical shell or hollow structure may also feature a detent or a latch (not shown) that more firmly retains the winch anchor in position on or around the winch drum.

Since the winch anchor of the personal support device mates with the winch body or the winch top socket several inches outboard of the edge of the cockpit, the connecting spacer 12 operates to laterally offset the body support of the personal support device in the direction of the cockpit. The connecting spacer may be implemented, for example, using inexpensive standard tubing, as shown, for example, in FIG. 2 and FIG. 4. Preferably, the connecting spacer is made of appropriate weather-resistant material.

Figure 6:
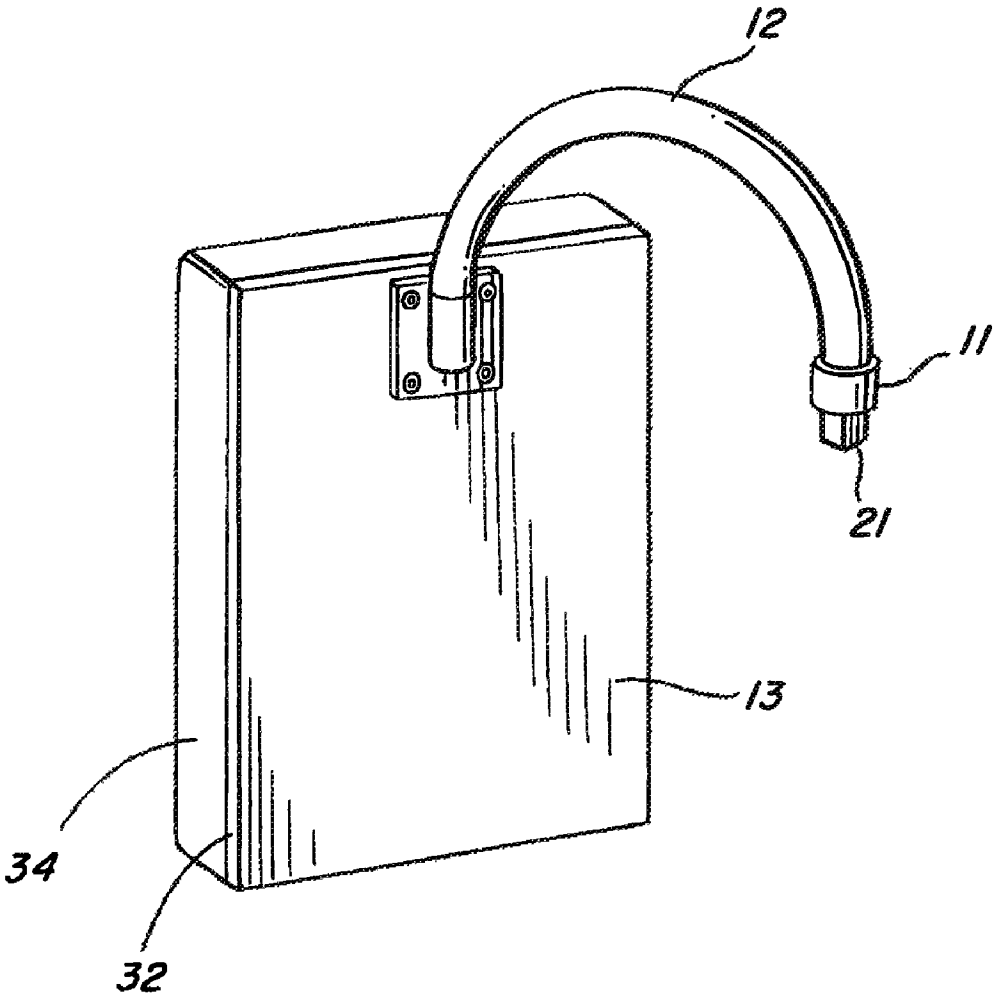
FIG. 6 is a perspective view of an embodiment of a personal support device featuring a semicircular positioning spacer.
Figure 7:
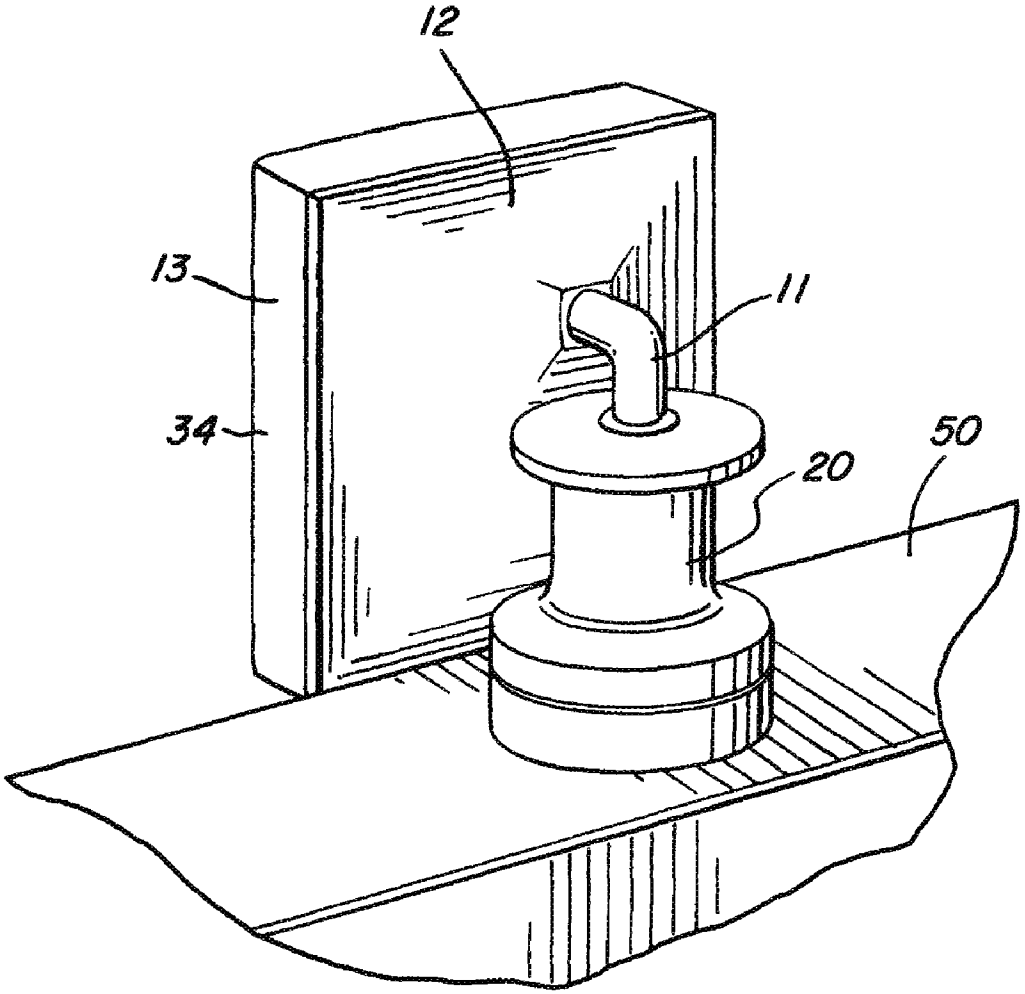
FIG. 7 is a perspective view of an embodiment of a personal support device whose positioning spacer is a shell.

The connecting spacer need not be a simple tubing strut or exclusively horizontal; it could, for example, be semicircular in shape, as shown in the connecting spacer 12 in FIG. 6, or diagonal in shape, or may comprise a platform, or may comprise a hollow or solid shell extending from the winch anchor to the body support, as is the connection spacer 12 shown in FIG. 7. Any of these configurations may be fabricated from any material of sufficient strength, or from any suitable combination of materials.

Figure 8B:
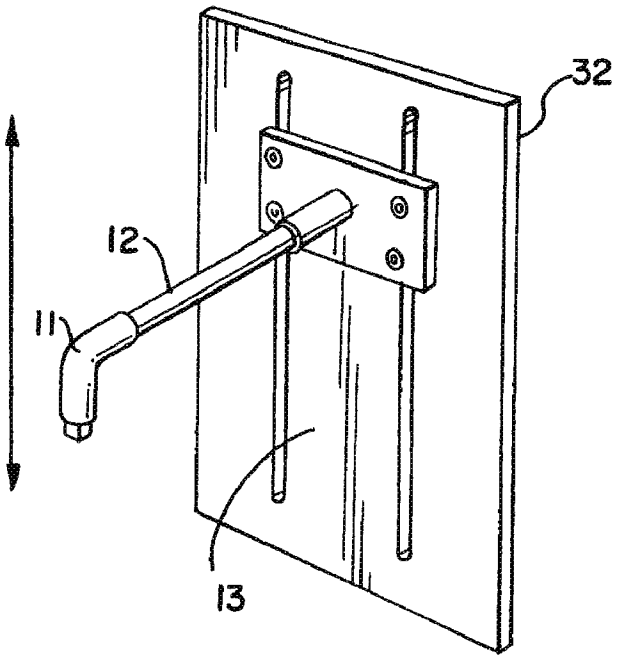
FIG. 8B is a perspective view of an embodiment of an adjustable personal support device whose body support is a solid platform, with a slidably mounted positioning spacer. positioned relatively high on the body support.
Figure 8A:
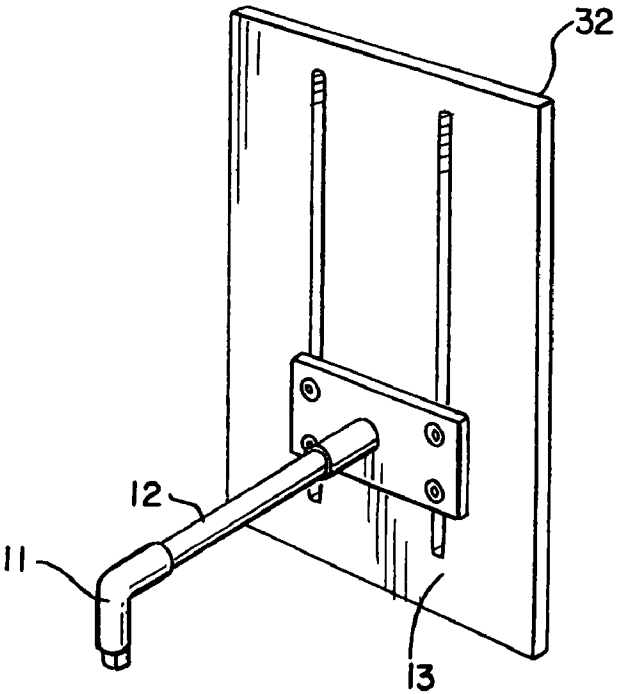
FIG. 8A is a perspective view of an embodiment of an adjustable personal support device whose body support is a solid platform, with a slidably mounted positioning spacer positioned relatively low on the body support.
Figure 9:
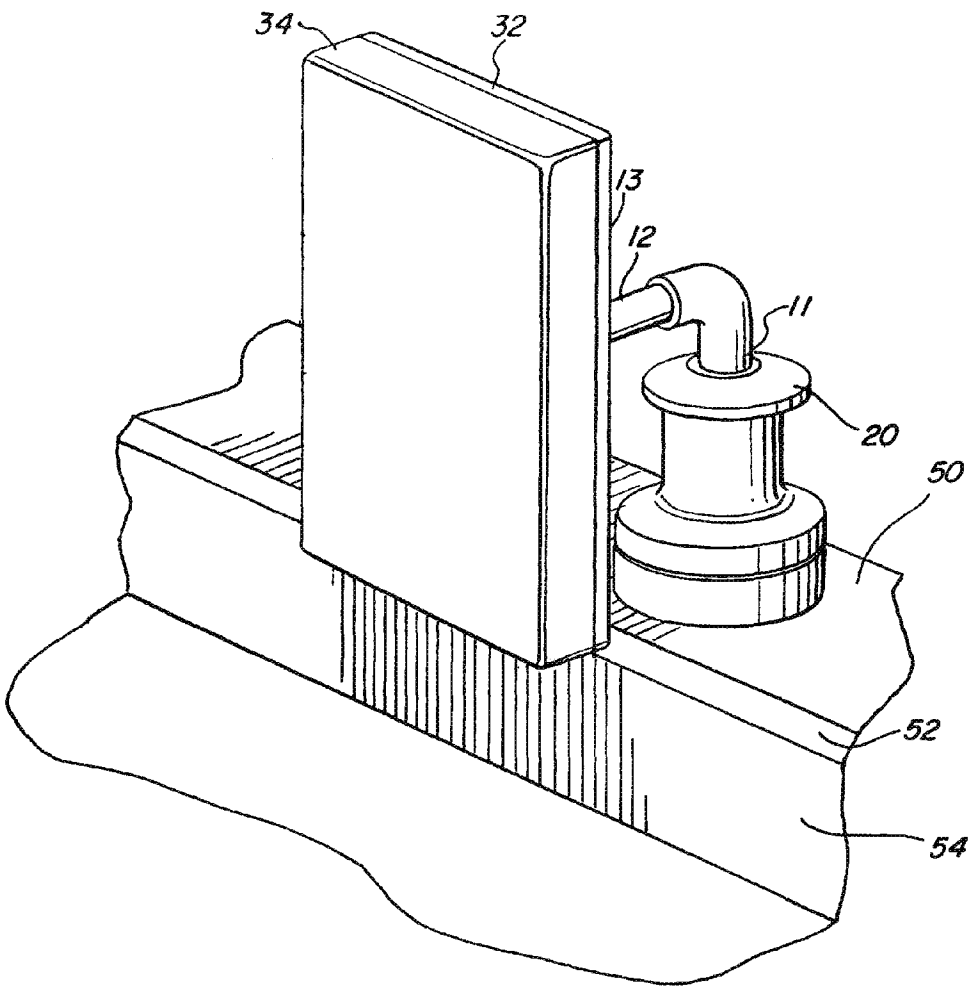
FIG. 9 is a perspective view of an embodiment of a personal support device inserted into the top socket of a nautical winch, showing the positioning of the personal support device against the sloping surface between the cockpit and the winch/coaming deck.

In one embodiment of the present invention, a body support is positioned at or near the edge of the cockpit for contact with some portion of the user's body. The body support 13 in the embodiment shown in FIG. 4 supports a user's back, and comprises a firm support platform 32 and also a cushion 34 for the user's comfort. The cushion may be configured to be removably attached to the rest of the body support, for example by snaps or by a removable hook-and-loop fastener system such as marketed under authority of Velcro Industries B.V. under the trademark Velcro®, to allow easy removal of the cushion for cleaning, storage, or replacement. The body support may also be a simple solid platform, as shown in platform 32 in FIGS. 8A and 8B. The body support may be constructed of any material of suitable strength, for example a rigid plastic material, wood or a wood-based material, or metal or a metallic material. As shown in FIG. 9, the bottom edge of the body support 13 can be lodged against the typically occurring sloping surface 52 where the winch/coaming deck 50 meets the cockpit wall 54, to steady the body support and lend additional stability to the personal support device.

Figure 10:
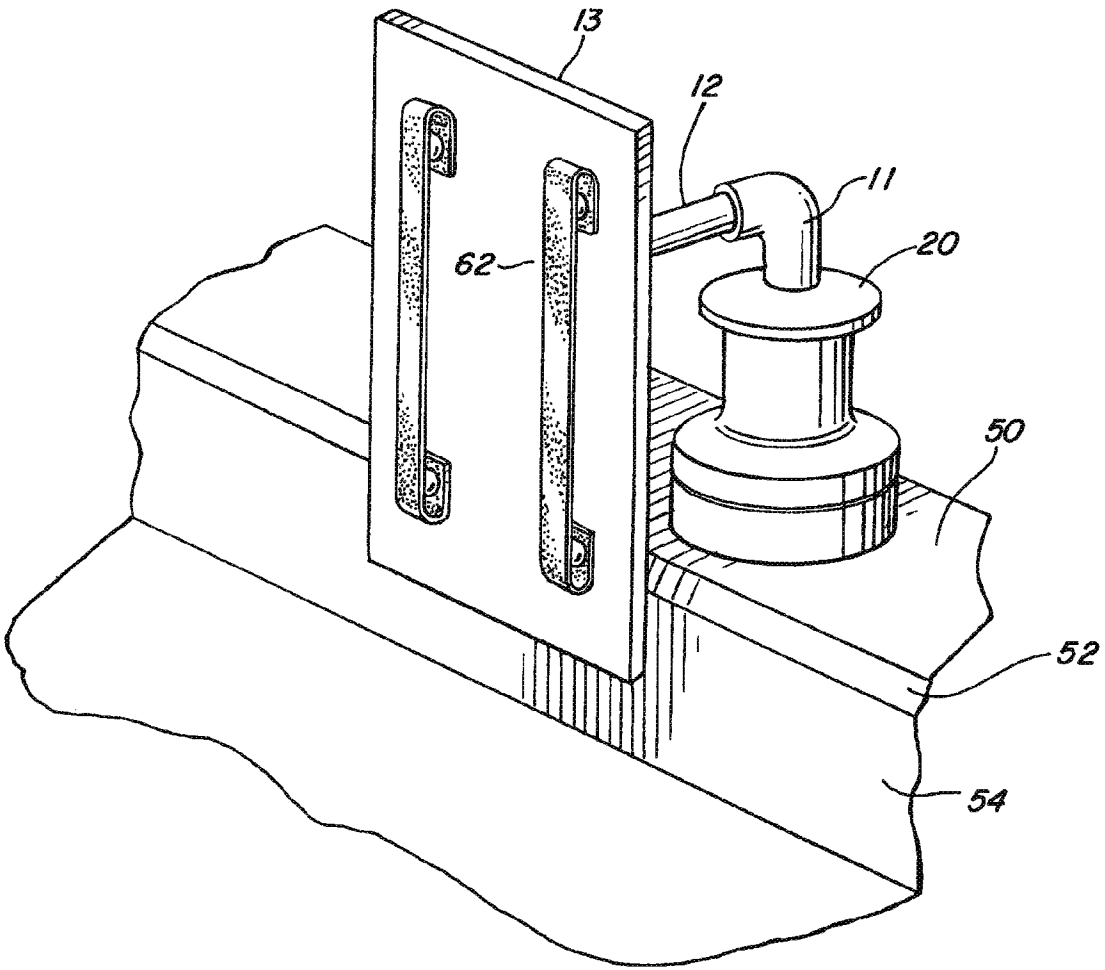
FIG. 10 is a perspective view of an embodiment of a personal support device whose body support features straps for more firmly securing a person's body.
Figure 11:
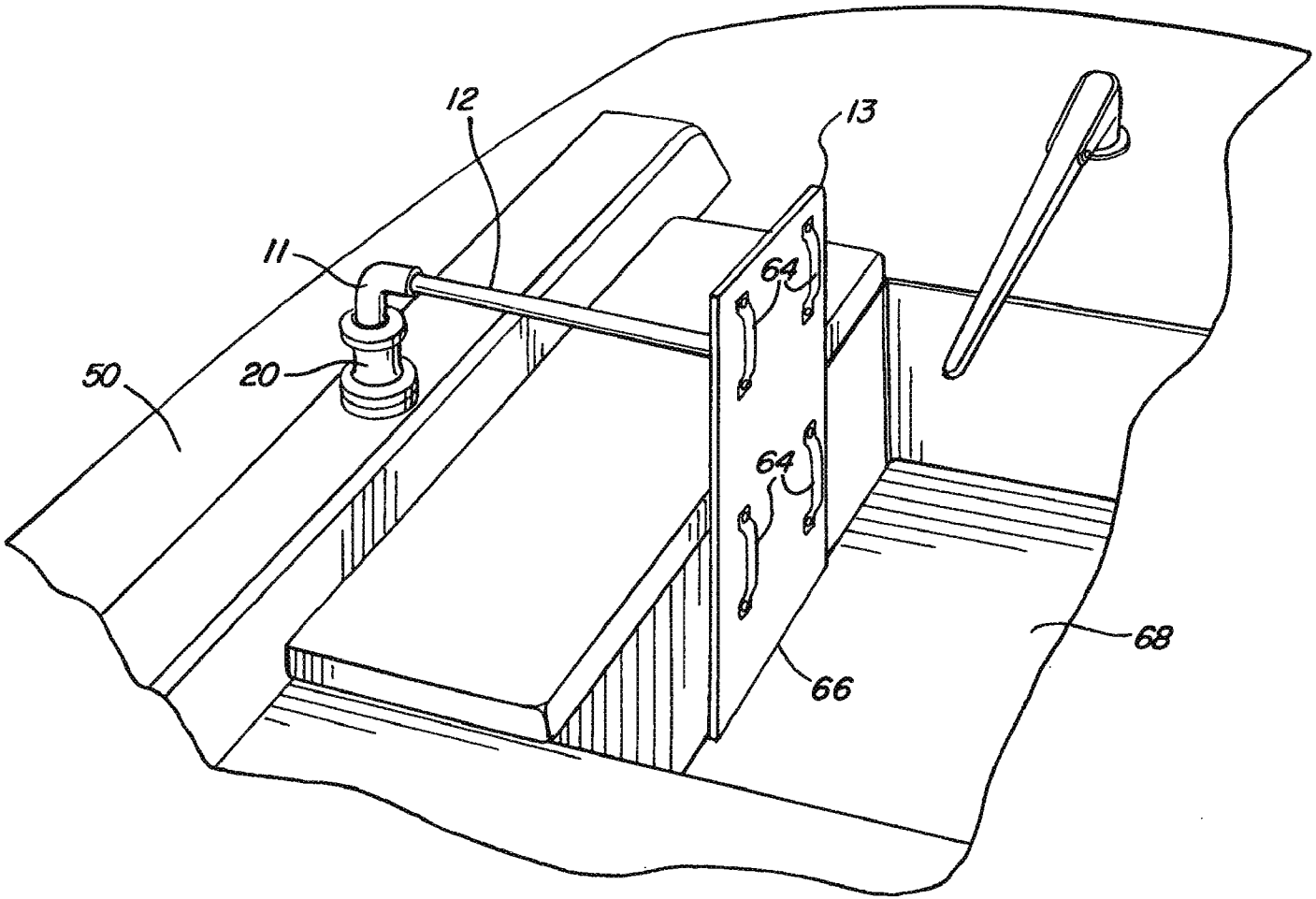
FIG. 11 is a perspective view of an embodiment of a personal support device whose body support extends down to the floor of the cockpit and features handles for a person in various bodily positions to grip.

FIG. 10 shows another embodiment, in which the body support 13 features straps 62, or, as shown in FIG. 11, it may feature handles 64 or other means of secure bodily gripping, attachment or anchoring for securing more firmly the passenger's body, which is advantageous for example when the vessel is in rough water. This may be advantageously combined with a winch anchor featuring a latch or a detent (not shown) to permit the personal support device to engage more firmly the winch or winch-substitute device, which is also advantageous in rough water.

FIG. 11 shows another embodiment, wherein the body support 13 may be positioned to extend further into the cockpit, with or without additional stabilizing portions in addition to the winch anchor, such as an additional portion 66 of the body support that extends to the floor 68 of the cockpit, and may provide support to other parts of a person's body besides the back, with the person in a standing, sitting, kneeling, or other position.

The embodiment shown in FIG. 4 is entirely fixed and nonadjustable, and is very inexpensive and easy to manufacture using standard parts. A fully fixed personal support device is suitable for use on a particular vessel, where the lateral and vertical dimension of the winch, the winch/coaming deck, and the cockpit wall do not change. This embodiment is also fully squared, using only right angles of connection and attachment (such as elbow 36) between the winch anchor, the connecting spacer, and the body support. Because a nautical winch is typically canted from six to ten degrees from the vertical, which is coincidentally also the angle used in the manufacture of comfortable furniture backs, a simple, fully squared personal support device yields a seatback that reclines at a comfortable angle for the user.

Figure 12B:
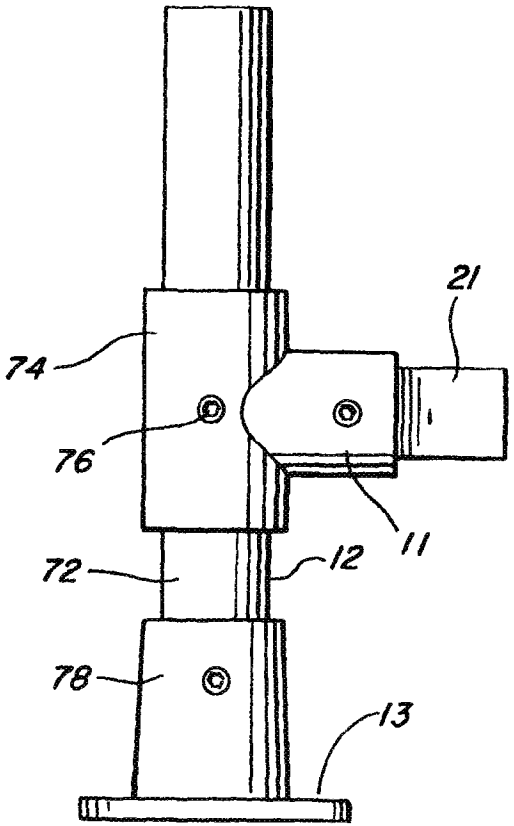
FIG. 12B is a perspective view of an embodiment of an adjustable personal support device whose positioning spacer is implemented with tubing and a tubing collar and whose winch anchor is slid closer to the body support.
Figure 12A:
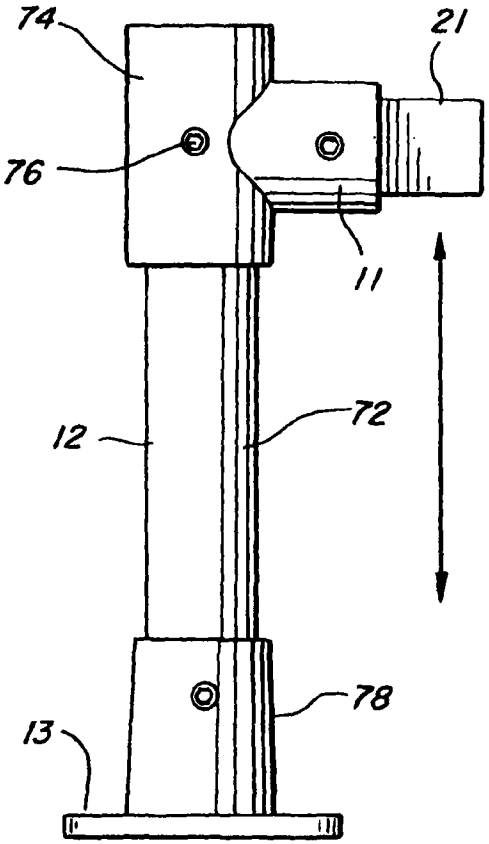
FIG. 12A is a side view of an embodiment of an adjustable personal support device whose positioning spacer is implemented with tubing and a tubing collar and whose winch anchor is slid farther from the body support.

However, a personal support device need not be fixed in its construction. Making it adjustable in one or more degrees enables it to be adapted for use on different vessels that have different distances between the winch and the cockpit wall and different heights between the top of the winch and the top of the cockpit wall. It also allows a user to position the device for personal comfort or preference. The connecting spacer of the embodiment shown in FIGS. 12A and 12B features slidable and rotatable components, for example standard tubing 72 and a tubing collar 74 such as those used as "tee" handrail fittings. In this embodiment, the tubing collar 74 can be slid along the tubing 72 to set the desired distance between the winch anchor 11 and the body support 13, and then tightened around the tubing 72 to lock the desired length in place. FIG. 12A shows the body support at a maximal spacing from the winch anchor, and FIG. 12B shows the body support at a decreased spacing from the winch anchor, with the tubing collar 74 slid along the tubing 72. The adjustment mechanism 76 can be implemented with connection hardware offering occasional release and locking using tools, or alternatively offering immediate hand release and locking by a user without requiring tools.

Figure 13:
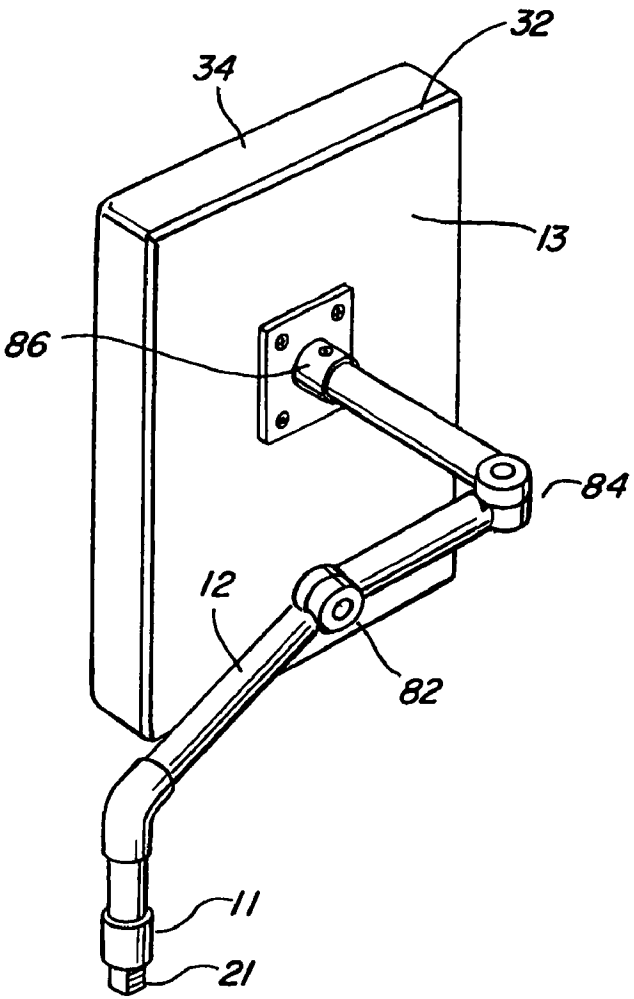
FIG. 13 is a perspective view of an embodiment of an adjustable personal support device featuring multiple adjustment mechanisms suitable for adjusting the body support in various dimensions.
Figure 18:
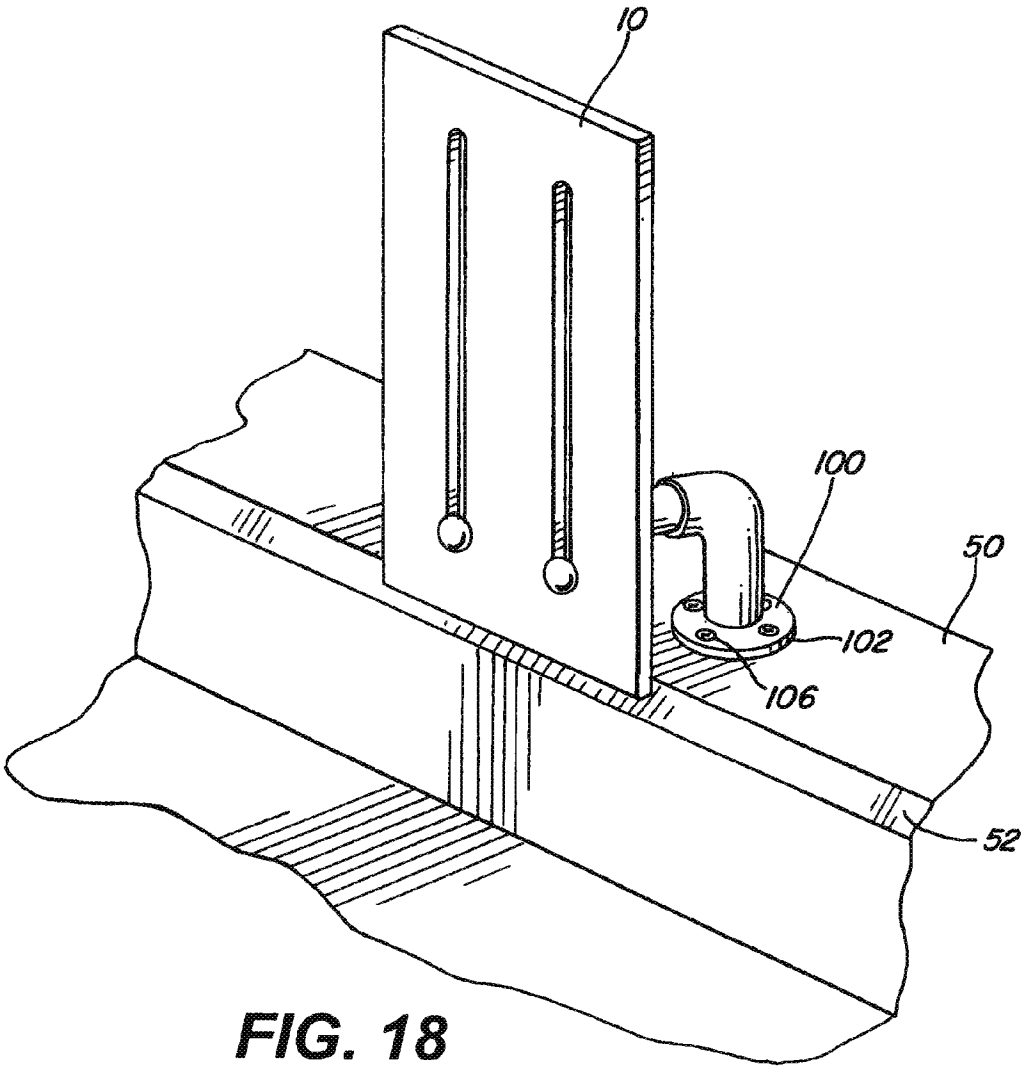
FIG. 18 is a perspective view of an embodiment of an adjustable personal support device engaging an embodiment of a winch-substitute device, with the personal support device's winch anchor positioned relatively lower and its body support extending mostly upward from the positioning spacer attach point.

In addition, the body support and positioning spacer can be adjustable in a number of ways. As shown in FIGS. 8 and 18, the body support can be slidably attached to the connecting spacer to allow it to have an adjustable vertical position, and thus can be slid down to contact a lip or sloped surface 52 adjacent to the cockpit wall edge for additional stability. As shown in FIG. 13, the body support can be adjustably connected to the positioning spacer and the positioning spacer itself can be adjustable. With suitable adjustment mechanisms 82, 84, and 86 inserted in the positioning spacer or between the positioning spacer and the body support, the body support can be adjusted in any dimension, for example allowing the body support to be selectably reclined, to swivel fore or aft, or to rotate about its normal axis. Locating the connection point between the positioning spacer and the body support away from the center of the body support allows the body support after rotation about its normal axis to extend a greater distance in an upward, downward, rightward or leftward direction. Once adjusted, the body support may be secured using any suitable locking or immobilizing means, for example, a clamp, a pressure knob, a bolt and wing nut, or a cotter pin.

Figure 14:
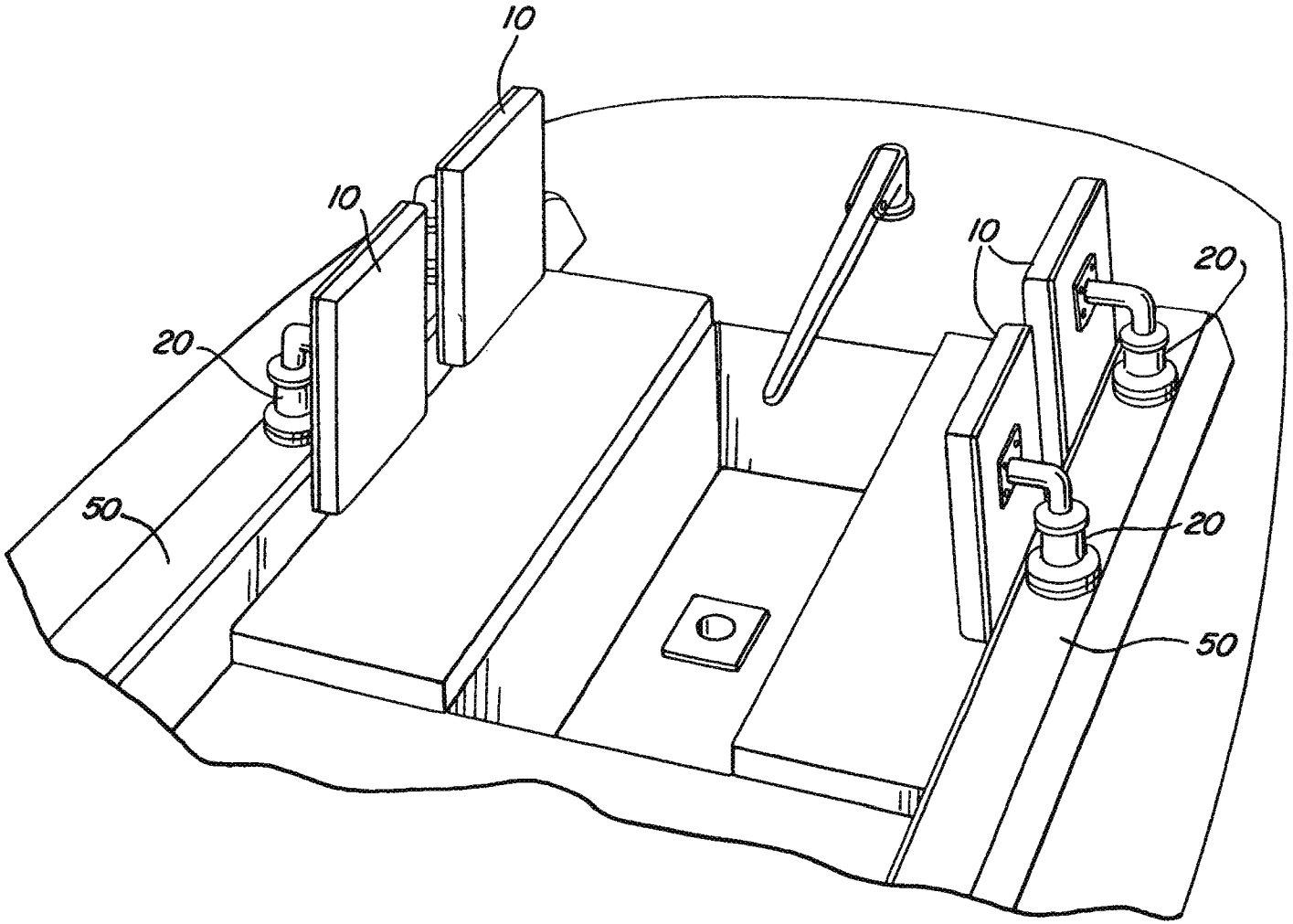
FIG. 14 is a perspective view of the cockpit and winch/coaming decks of a typical nautical vessel employing multiple personal support devices.
Figure 15:
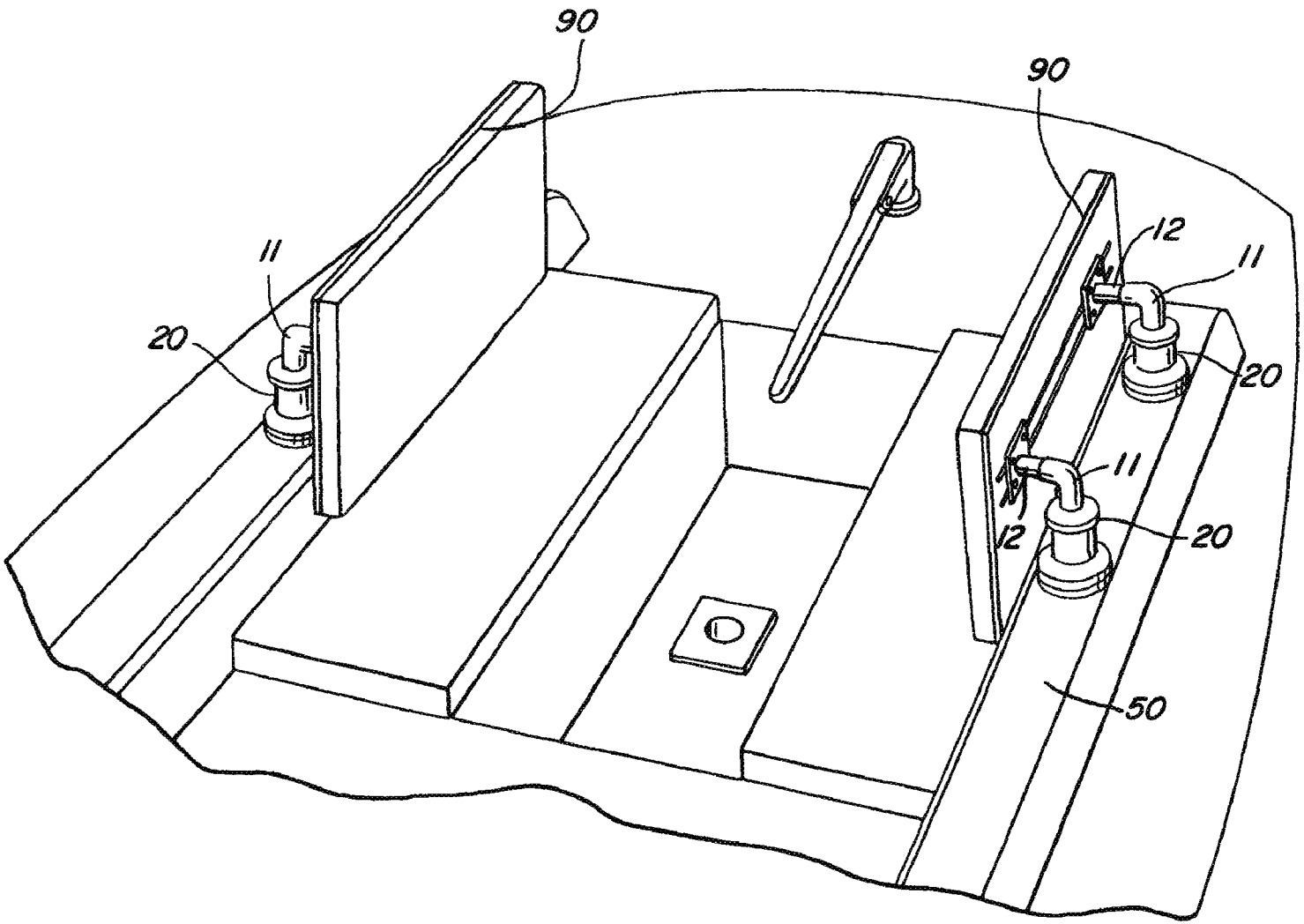
FIG. 15 is a perspective view of the cockpit and winch/coaming decks of a typical nautical vessel employing personal support devices configured for use by multiple persons and engaging multiple winches.

Multiple personal support devices 10 may be employed in the cockpit for various passengers or seating positions, as shown in FIG. 14. FIG. 15 shows another embodiment comprising a bench-width body support 90 anchored by multiple winches 20 using multiple winch anchors 11 and positioning spacers 12, useable by a person in various locations in the cockpit or by multiple persons. In addition to the attachment points of the positioning spacers to the body support being vertically adjustable, in this embodiment they may be horizontally adjustable to match the distance between the various positioning spacers 12 to the horizontal spacing between the winches 20.

Winch-Substitute Device

Because the disclosed personal support device is removable, it can be used with any number of different winches near the cockpit of a nautical vessel. However, allowing it to be positioned in locations where there is no winch makes its usage even more versatile. This can be accomplished by use of a device that substitutes for the salient features of a winch, positioning such a device near the edge of the cockpit wall where it may mate with the winch anchor of a personal support device. Such a winch-substitute device may, for instance, present an opening similar to a winch top socket that receives the winch post of a personal support device.

Figure 16B:
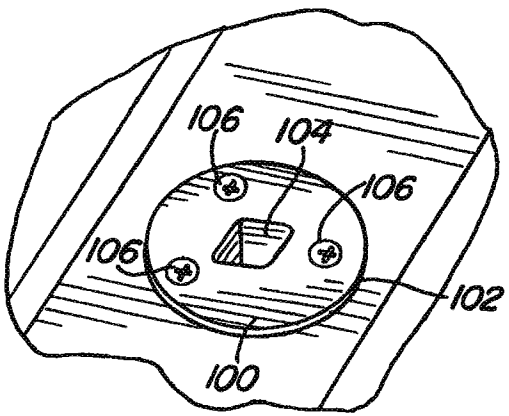
FIG. 16B is a detail view of an embodiment of a winch-substitute device with a fitting presenting an opening engageable with the winch post of a personal support device.
Figure 16A:
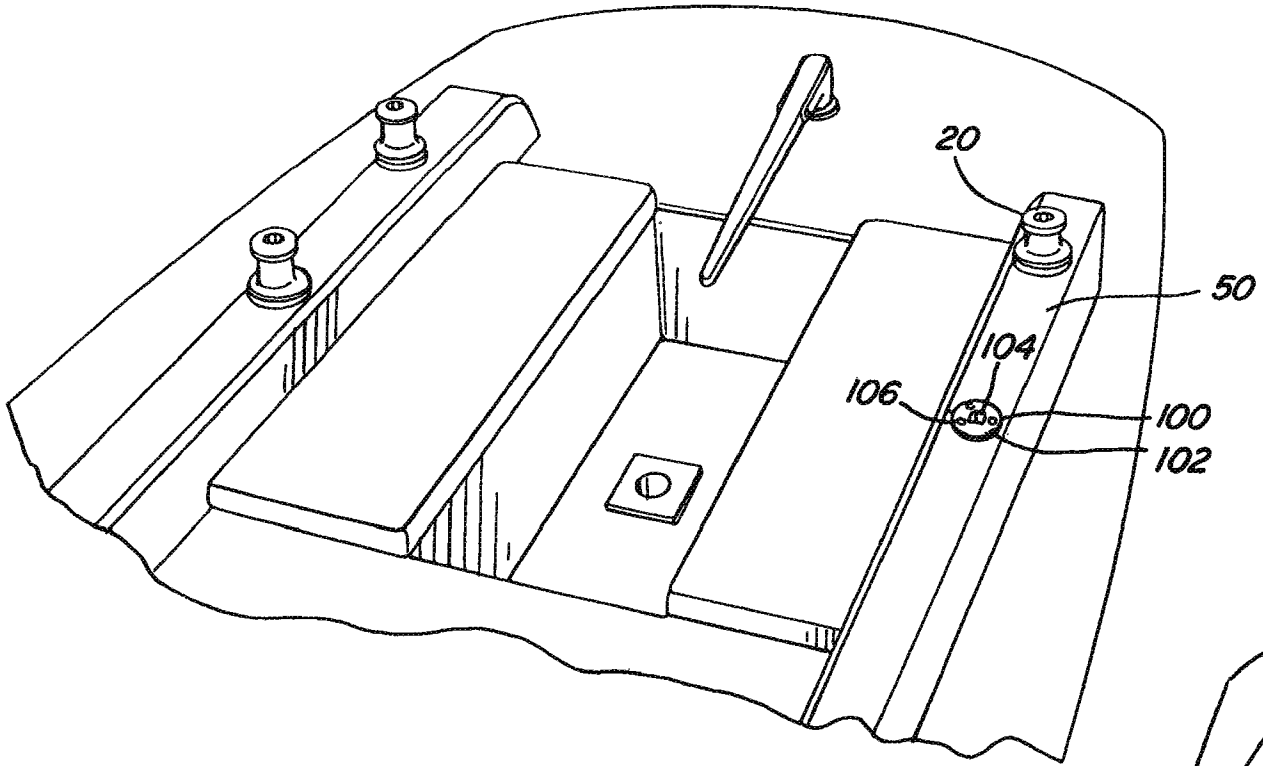
FIG. 16A is a perspective view of the cockpit and winch/coaming decks of a typical nautical vessel equipped with both a winch and a winch-substitute device.
Figure 17:
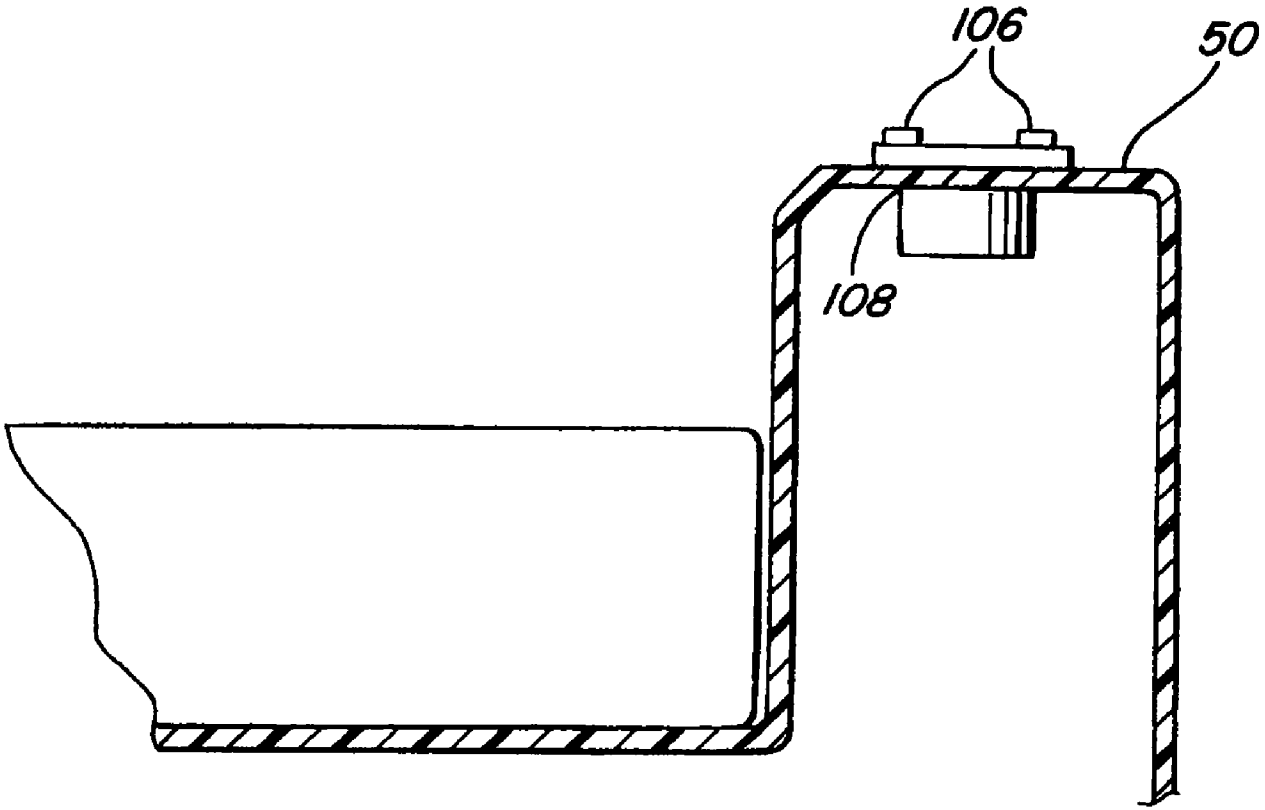
FIG. 17 is a side cutaway view of an embodiment of a winch-substitute device mounted into the winch/coaming deck of a nautical vessel.

Accordingly, FIGS. 16A and 16B show a winch-substitute device in another embodiment of the present invention. The winch-substitute device 100 in this embodiment comprises a fixture 102 presenting a recess 104 that features either a square or an octagonal opening in the standard size of a winch top socket. The fixture may be secured to the nautical vessel in a number of ways that would be known to those skilled in the art; for example, as shown in FIG. 17 it may mounted into the winch/coming deck 50 by drilling a suitable hole 108 in the deck to encompass the recess and securing the fixture into the deck using screws 106, adhesive, or similar connection method. The recess of the winch-substitute device is capable of receiving the winch pin of the personal support device. FIG. 18 shows a winch-substitute device 100 mounted into the winch/coming deck 50 and engaging a personal support device 10 according to the present invention. A winch post of a personal support device (not visible) releasably engages the recess (not visible) of the winch-substitute device in the same way it releasably engages a winch top socket 22, as shown for example in FIGS. 3 and 4. Placing the winch post into the recess locates a personal support device 10 in relation to the winch-substitute device 100 in the same way that a personal support device may be located in relation to the top socket of an actual winch 20, as shown for example in FIG. 4. The winch-substitute device may also feature a detent or latching device (not shown) that more firmly retains the personal support device in position in the winch-substitute device's recess, requiring for example either firmer applied force or release of a latch before the personal support device may be removed. Once the personal support device 10 engages the winch-substitute device 100, the body support may be seated against the cockpit lip or sloping wall 52, as shown in FIG. 18.

Figure 19:
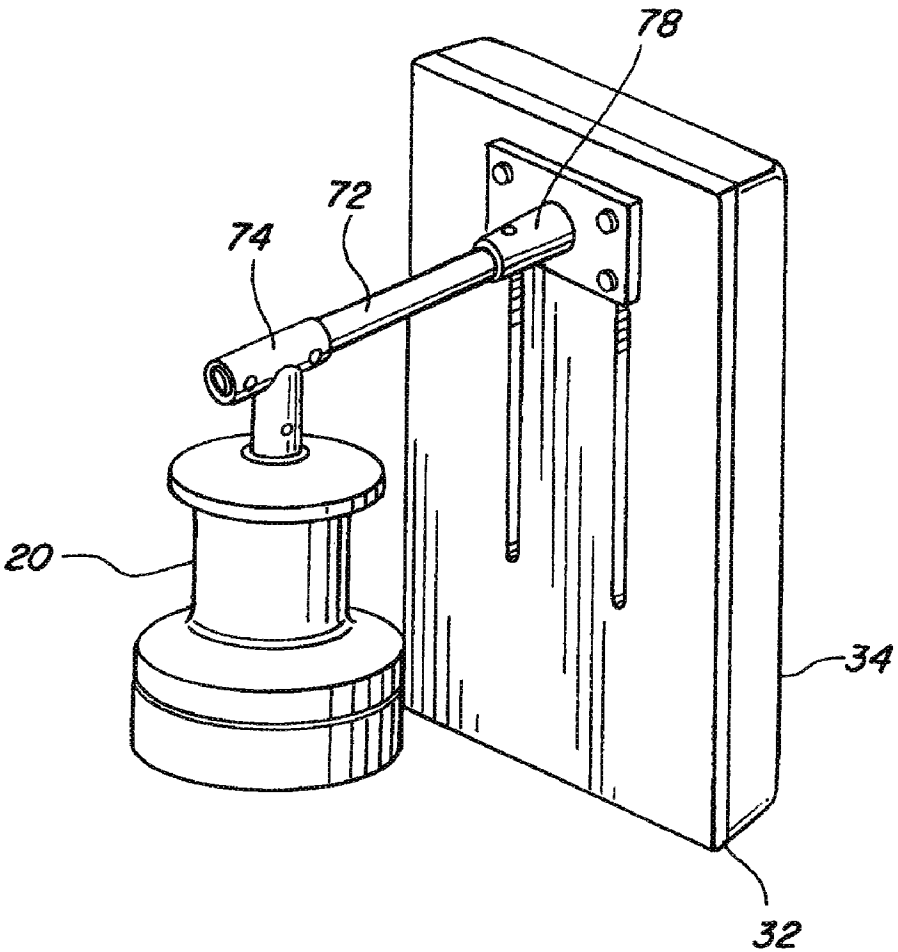
FIG. 19 is a perspective view of an embodiment of an adjustable personal support device engaging a winch, with its winch anchor positioned relatively higher and its body support extending mostly downward from the positioning spacer attach point.

When using a winch-substitute device embedded directly in the winch/coaming deck, the attachment point of the body support is lower than when using an actual winch. This can be compensated for, for example, by a personal support device having a body support rotatable about its normal axis, as shown for example in FIG. 13; the body portion may then be rotated from a first position that extends basically downward from a higher connection point, as shown in FIG. 19, to a second position that extends basically upward from a lower connection point, as shown in FIG. 18. In an embodiment where the positioning spacer is implemented with tubing 72 and a tubing collar 78, as shown for instance in FIG. 19, this rotation can be achieved by rotating the tubing within the collar through 180 degrees.

Figure 20:
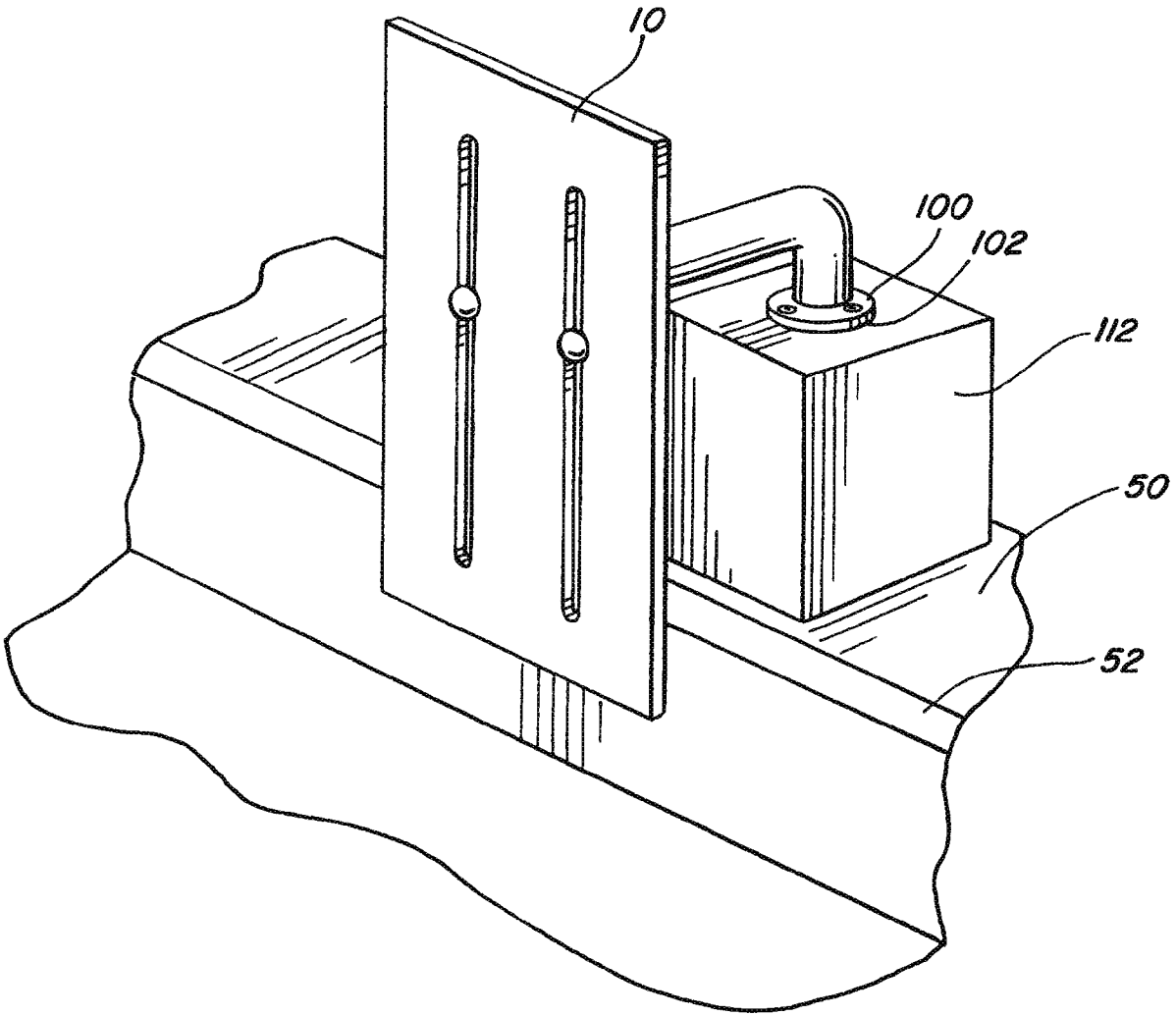
FIG. 20 is a perspective view of an embodiment of a winch-substitute device presenting at a height above the winch/coaming deck substantially equal to the height of the top socket of a nautical winch, a recess engageable with the winch post of certain embodiments of a personal support device.

FIG. 20 shows another embodiment that addresses the issue of vertical height of the personal support device when using a winch-substitute device. In this embodiment, the recess of the winch-substitute device 100 is located at a vertical height approximating the height of a winch, for instance by its fitting 102 being mounted atop a box-shaped structure 112 instead of being embedded directly in the winch/coaming deck 50; this allows easy positioning of a fixed-construction personal support device at the same vertical height as when using an actual winch. The box shaped structure may be permanently or releasably attached to the winch/coaming deck 50 or other structure of the vessel near or in the cockpit. If it is releasably attached, the winch-substitute device thus features a portable structure that may releasably engage the winch/coaming deck or other structure near or in the cockpit to present a portable, removable anchoring point for a personal support device.

Figure 21:
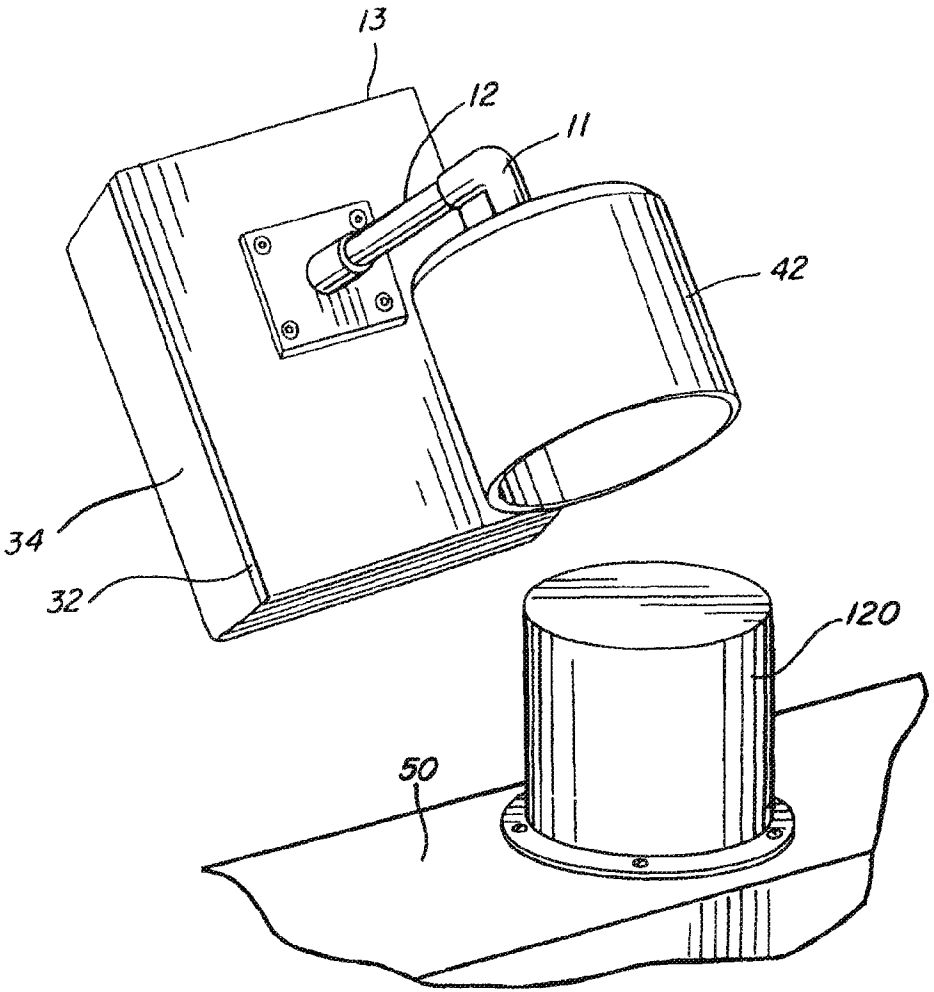
FIG. 21 is a perspective view of an embodiment of a winch-substitute device presenting a generally cylindrical fitting engageable with the generally cylindrical shell featured in the winch anchor of certain embodiments of a personal support device.

FIG. 21 shows another embodiment, in which the winch-substitute device 120 engages a configuration of the winch anchor of a personal support device 10 that is other than a winch post. In this exemplary embodiment, a winch-substitute device 120 having a shape roughly corresponding to a winch's cylindrical drum releasably engages a winch anchor 11 of a personal support device 10 featuring a generally cylindrical shell 42 or other hollow structure that when used with an actual winch 20 fits down over and receives at least part of the winch drum.

Although limited embodiments of the present invention have been specifically described and illustrated, many modifications, combinations, and variations will be apparent to those skilled in the art. Accordingly, it is to be understood that a personal support system constructed according to the principles of this invention may be embodied other than as specifically described herein. The invention is also defined in the following claims.

What is claimed is:

1. A device for supporting or securing one or more persons aboard a nautical vessel that has a winch proximate to a cockpit, comprising:

a body support comprising a platform and capable of engaging at least a portion of a body of a person who is located at least partially in the cockpit;

a winch anchor releaseably engageable with the winch and comprising a post shaped to fit within a top socket of the winch; and a positioning spacer connected to the body support and connected to the winch anchor, and having a length for fixing a distance between the winch anchor and the body support.

2. The device of claim 1, wherein the winch anchor comprises a mechanism configured to retain more firmly the engagement of the winch anchor with the winch.

3. The device of claim 2, wherein the mechanism is a detent or a latch.

4. The device of claim 1, wherein the post is octagonal in cross section.

5. The device of claim 1, wherein the post is square in cross section.

6. The device of claim 1, wherein the positioning spacer comprises tubing.

7. The device of claim 1, wherein the position of the body support relative to the winch anchor may be adjusted.

8. The device of claim 1, wherein the body support comprises pliable padding.

9. The device of claim 8, wherein the padding is removable from the device.

10. The device of claim 1, wherein the body support comprises at least one strap.

11. The device of claim 1, wherein the body support comprises at least one handle.

12. The device of claim 1, wherein an angle of the body support with respect to at least one of its horizontal, vertical, or normal axes may be adjusted.

13. The device of claim 1, wherein the device is configured to engage multiple winches simultaneously.

14. The device of claim 1, wherein the device is configured to engage bodies of a plurality of people simultaneously.

15. A winch-substitute device for use with a personal support device that is for a nautical vessel and that comprises a body support configured to engage a body of a person located at least partially in a cockpit of the vessel, a winch anchor releaseably engageable with a winch on the vessel, and a positioning spacer extending between the body support and the winch anchor and having a length for fixing a distance between the winch anchor and the body support, wherein the winch-substitute device comprises a fitting releaseably engageable with the winch anchor to position or support the personal support device.

16. The device of claim 15, wherein the device comprises a mechanism configured to retain more firmly the engagement of the winch anchor with the device.

17. The device of claim 15, wherein the fitting comprises a recess capable of releasably engaging a winch post of the personal support device.

18. The device of claim 17, wherein the recess is located in a winch/coaming deck of the vessel.

19. The device of claim 17, wherein the recess is located in a structure affixed to a winch/coaming deck of the vessel.

20. The device of claim 19, wherein the recess is positioned above the winch/coaming deck at a height substantially equal to a height above the winch/coaming deck of a top socket of a nautical winch.

21. The device of claim 15, wherein the fitting is mounted into a structure removably attachable to the vessel.

22. The device of claim 15, wherein the fitting is configured to be releaseably received by a generally cylindrical cavity presented by the winch anchor.

23. A personal support device for a nautical vessel, comprising:

means for supporting back of a body of a person who is located at least partially in a cockpit of the nautical vessel, means for releasably engaging the device with a winch on the vessel; and means connected to the supporting means and connected to the releasably engaging means for positioning the supporting means to permit the supporting means to engage the back of the body.

24. A method of supporting or securing a body of at least one person located at least partially in a cockpit of a nautical vessel that has a winch, performed by:

providing a personal support device having a body support comprising a platform and configured to engage at least a portion of the body, a winch anchor releaseably engageable with the winch and comprising a post shaped to fit within a top socket of the winch, and a positioning spacer connected to the body support and connected to the winch anchor and having a length for fixing a distance between the winch anchor and the body support;

positioning the winch anchor to engage the winch; and positioning the body to engage the body support.

25. A device for supporting or securing one or more persons aboard a nautical vessel that has a winch proximate to a cockpit, comprising:

a body support comprising a device for securing at least a portion of a body of a person who is located at least partially in the cockpit, which device in turn comprises at least one strap;

a winch anchor releaseably engageable with the winch; and a positioning spacer connected to the body support and connected to the winch anchor, and having a length for fixing a distance between the winch anchor and the body support.

26. A device for supporting or securing one or more persons aboard a nautical vessel that has a winch proximate to a cockpit, comprising:

a body support capable of engaging a back of a body of a person who is located at least partially in the cockpit;

a winch anchor releaseably engageable with the winch; and a positioning spacer connected to the body support and connected to the winch anchor, and having a length for fixing a distance between the winch anchor and the body support.

27. The device of claim 26, wherein the winch anchor comprises a post shaped to fit within a top socket of the winch.

28. The device of claim 26, wherein the position of the body support relative to the winch anchor may be adjusted.

29. The device of claim 26, wherein the body support comprises pliable padding.

30. The device of claim 26, wherein the winch anchor comprises a mechanism configured to retain more firmly the engagement of the winch anchor with the winch.

31. The device of claim 26, wherein the winch anchor is configured to contact the winch through an adaptor.

32. The device of claim 26, wherein an angle of the body support with respect to at least one of its horizontal, vertical, or normal axes may be adjusted.

* * * * *